US009671745B2

(12) United States Patent
Maeda et al.

(10) Patent No.: US 9,671,745 B2
(45) Date of Patent: Jun. 6, 2017

(54) IMAGE FORMING APPARATUS

(71) Applicant: CANON KABUSHIKI KAISHA, Tokyo (JP)

(72) Inventors: Masanori Maeda, Yokohama (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 14/948,510

(22) Filed: Nov. 23, 2015

(65) Prior Publication Data

US 2016/0154370 A1 Jun. 2, 2016

(30) Foreign Application Priority Data

Nov. 28, 2014 (JP) ..... 2014-242585

(51) Int. Cl.
*G03G 21/16* (2006.01)
*G03G 15/20* (2006.01)

(52) U.S. Cl.
CPC ..... *G03G 21/1633* (2013.01); *G03G 15/2028* (2013.01)

(58) Field of Classification Search
CPC ..... G03G 21/1633; G03G 15/2028
USPC ..... 399/114
See application file for complete search history.

(56) References Cited

U.S. PATENT DOCUMENTS 7,690,651 B2 * 4/2010 Kubochi ..... G03G 15/657 271/258.01
8,478,176 B2 * 7/2013 Tagami ..... G03G 15/2003 399/122
2004/0175204 A1 * 9/2004 Kouzu ..... G03G 21/1638 399/124
2007/0077104 A1 * 4/2007 Hasegawa ..... G03G 15/6529 399/328
2007/0253756 A1 * 11/2007 Uehara ..... G03G 15/234 399/322
2010/0189478 A1 * 7/2010 Takahashi ..... G03G 15/2032 399/331
2012/0163880 A1 * 6/2012 Kuroki ..... G03G 15/5058 399/301
2013/0287434 A1 * 10/2013 Hisano ..... G03G 21/1633 399/110

(Continued)

FOREIGN PATENT DOCUMENTS

JP 2003-140480 A 5/2003
JP 2003140480 A * 5/2003

(Continued)

*Primary Examiner* — Francis Gray

(74) *Attorney, Agent, or Firm* — Canon U.S.A., Inc. IP Division

(57) ABSTRACT

The present invention provides an image forming apparatus that includes a first opening/closing member arranged to be openable and closable with respect to a main body of the image forming apparatus, a second opening/closing member, a unit detachably attachable to the main body, and a crank mechanism configured to convert reciprocating motion caused by an opening and closing operation of the first opening/closing member into rotating motion of the second opening/closing member. A first distance from a moving area of the unit is configured to be greater than a second distance from the moving area to thereby suppress an increase in the size of the image forming apparatus.

10 Claims, 12 Drawing Sheets

(56) References Cited

U.S. PATENT DOCUMENTS

| | | | | |
|---|---|---|---|---|
| 2013/0308974 | A1* | 11/2013 | Wang | G03G 21/1633 399/107 |
| 2014/0099142 | A1* | 4/2014 | Ando | G03G 21/1633 399/110 |
| 2015/0063868 | A1* | 3/2015 | Fukuda | G03G 15/2028 399/122 |

FOREIGN PATENT DOCUMENTS

| | | | | |
|---|---|---|---|---|
| JP | 2006-047593 | A | | 2/2006 |
| JP | 2006047593 | A | * | 2/2006 |
| JP | 2013-254068 | A | | 12/2013 |
| JP | 2014-170152 | A | | 9/2014 |
| JP | 2015-106126 | A | | 6/2015 |

* cited by examiner

IMAGE FORMING APPARATUS

BACKGROUND OF THE INVENTION

Field of the Invention

The present invention relates to an image forming apparatus including a fixing unit that fixes a toner image formed on a recording material to the recording material.

Description of the Related Art

An image forming apparatus using an electrophotographic recording technique has a door openable and closable with respect to a main body of the image forming apparatus to enable a user to perform jam handling of a recording material, maintenance of the image forming apparatus, and replacement of a replaceable unit. When the door is open, the user may possibly touch the inside of a fixing unit via an inlet of the fixing unit and so on. To avoid this, some image forming apparatuses include in each of them a shutter that is provided to the inlet of the fixing unit and moves in conjunction with the opening and closing of the door(Japanese Patent Application Laid-Open No. 2014-170152).

According to Japanese Patent Application Laid-Open No. 2014-170152, a rotating area of the shutter is provided inside the fixing unit. This increases the fixing unit in size and increases the image forming apparatus in size as well.

The rotating area of the shutter can be configured to be provided outside the fixing unit. FIG. 12 illustrates an example of such a configuration. In FIG. 12, a fixing unit 150 includes a roller pair PR inside. The roller pair PR forms a nip portion N for heating and fixing an unfixed toner image T formed on a recording material S. An arrow CD indicates a conveyance direction of the recording material S. A shutter 161 is arranged on an inlet IN through which the recording material S is inserted into the fixing unit 150. The shutter 161 is arranged to be rotatable with regard to a shaft 161*a*. The shutter 161 moves to a position 161(close) in which to close the inlet IN, and a position 161(open) in which to open the inlet IN. The shutter 161 includes a abutment portion 161*b* with which the door (not illustrated) of the main body of the image forming apparatus comes into contact. If the door is closed, the abutment portion 161*b* undergoes force illustrated by an arrow DP from the door side. If the door is open or, in other words, the inlet IN is closed by the shutter 161, the abutment portion 161*b* is in a shutter position 161*b*(close). If the door is closed or, in other words, the inlet IN is open, the abutment portion 161*b* is in a shutter position 161*b*(open).

As described above, the door of the main body of the image forming apparatus is provided to enable the user to perform such processing as the jam handing of a recording material, the maintenance of the image forming apparatus, and the replacement of a replaceable unit. Such processing is performed with the door open. If the door is opened, the shutter 161 and the abutment portion 161*b* of the shutter 161 move to the position illustrated by the full lines (close position). If the abutment portion 161*b* here protrudes greatly from the fixing unit 150 as illustrated by a distance PX, the abutment portion 161*a* may interfere with the foregoing processing. In particular, when taking a replaceable unit out of the main body of the image forming apparatus, the replaceable unit may undesirably interfere with the abutment portion 161*b*. Increasing the image forming apparatus in size as much as the distance PX to avoid the interference is also undesirable.

SUMMARY OF THE INVENTION

The present invention is directed to providing an image forming apparatus that can suppress the amount of protrusion of the portion protruding from the fixing unit.

According to an aspect of the present invention, an image forming apparatus for forming a toner image on a recording material includes a main body of the image forming apparatus, a first opening/closing member configured to form part of an outer casing of the main body and arranged to be openable and closable with respect to the main body, a second opening/closing member arranged inside the main body, a unit detachably attachable to the main body, the unit being attachable to and detachable from the main body in a state where the first opening/closing member is open, and a crank mechanism configured to convert reciprocating motion caused by an opening and closing operation of the first opening/closing member into rotating motion of the second opening/closing member, the crank mechanism including a crank pin and a bearing configured to hold the crank pin and either the crank pin or the bearing being arranged on part of the second opening/closing member, wherein in the state where the first opening/closing member is open, a first distance from a moving area within which the unit inside the main body moves when being attached to and detached from the main body to an abutment portion, included in the crank mechanism, with which the first opening/closing member comes into contact, is greater than a second distance from the moving area to the crank pin or the bearing.

According to another aspect of the present invention, an image forming apparatus for forming a toner image on a recording material includes a main body of the image forming apparatus, a first opening/closing member configured to form part of an outer casing of the main body and arranged to be openable and closable with respect to the main body, a second opening/closing member arranged inside the main body, a belt unit arranged inside the main body and configured to transfer the toner image to the recording material, the belt unit being attachable to and detachable from the main body in a state where the first opening/closing member is open, and a crank mechanism configured to convert reciprocating motion caused by an opening and closing operation of the first opening/closing member into rotating motion of the second opening/closing member.

Further features of the present invention will become apparent from the following description of exemplary embodiments with reference to the attached drawings.

DESCRIPTION OF THE EMBODIMENTS

Figure 1:
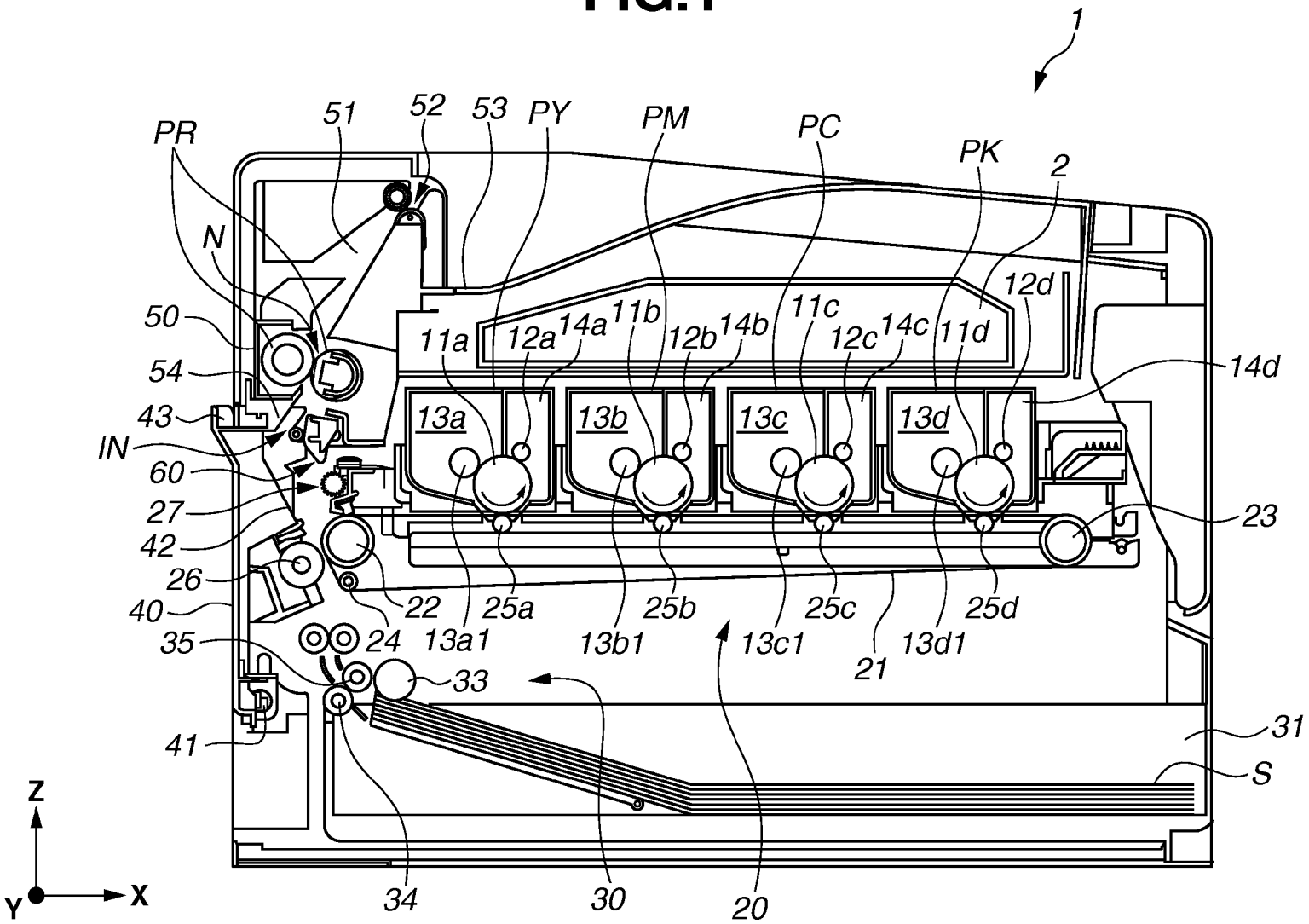
FIG. 1 is a sectional view of an image forming apparatus.

An image forming apparatus will initially be described with reference to the drawings. FIG. 1 is a sectional view of an image forming apparatus to which an exemplary embodiment of the present invention is applied. The image forming apparatus according to the present example is a four-color full color laser beam printer using an electrophotographic process.

As illustrated in FIG. 1, process cartridges PY, PM, PC, and PK are arranged in a row in a main body 1 of the image forming apparatus. The process cartridges PY, PM, PC, and PK have a similar configuration. The description thereof will thus be given here with the process cartridge PY only. The process cartridge PY includes a photosensitive drum 11*a*, a charging roller 12*a*, a developing device 13*a*, and a cleaning device 14*a* in its cartridge frame. The developing device 13*a* includes a developing roller 13*a*1, and stores toner in its container.

A laser scanner unit 2 is arranged over the process cartridges PY, PM, PC, and PK. The scanner unit 2 outputs laser light according to input image formation, and scans the surfaces of the respective photosensitive drums 11 with the laser light.

A belt unit 20 is arranged under the process cartridges PY, PM, PC, and PK. The belt unit 20 includes an endless belt 21 which serves as an intermediate transfer member, and a driving roller 22, a turn roller 23, and a tension roller 24 which stretch and rotate the endless belt 21. Four primary transfer rollers 25*a*, 25*b*, 25*c*, and 25*d* opposed to the respective photosensitive drums 11 via the endless belt 21 are arranged inside the endless belt 21. A secondary transfer roller 26 is put in contact with the driving roller 22 via the endless belt 21. A cleaning unit 27 for cleaning the endless belt 21 is arranged downstream, in a rotation direction of the endless belt 21, of a abutment portion of the endless belt 21 with the secondary transfer roller 26.

A sheet (recording material) supply unit 30 is arranged under the belt unit 20. The sheet supply unit 30 includes a sheet cassette 31, a feed roller 33, a separation roller 34, and a conveyance roller 35.

The main body 1 of the image forming apparatus has a door 40 (first opening/closing member) which is arranged to be openable and closable. The door 40 is rotatable about a rotation shaft 41. The door 40 forms part of an outer casing of the main body 1. The secondary transfer roller 26 and a conveyance guide 42 are held by the door 40. The door 40 is opened and closed by the user grasping and operating a door handle 43.

A fixing unit 50, a sheet discharge guide 51, and a discharge roller pair 52 are arranged downstream of a secondary transfer portion in a conveyance direction of a recording material.

Next, an operation for forming an image will be described. The photosensitive drums 11 are driven to rotate in a direction illustrated by arrows at a predetermined control speed. The endless belt 21 is also driven to rotate in a direction corresponding to the rotation of the photosensitive drums 11 at a speed corresponding to the speed of the photosensitive drums 11. With the photosensitive drums 11 and the endless belt 21 rotating, the charging roller 12 in the respective process cartridges PY, PM, PC, and PK uniformly charge the surfaces of the photosensitive drums 11 to a predetermined polarity and potential. The scanner unit 2 scans and exposes the surfaces of the photosensitive drums 11 with laser light according to image signals of respective colors. As a result, electrostatic latent images according to the image signals are formed on the surfaces of the respective photosensitive drums 11. The electrostatic latent images formed on the surfaces of the photosensitive drums 11 are developed into toner images by the respective developing devices 13. The toner images formed on the surfaces of the photosensitive drums 11 are superposed on the endless belt 21 by the primary transfer rollers 25, whereby an unfixed full color toner image is formed on the endless belt 21.

Meanwhile, sheets S in the sheet cassette 31 are fed by the separation roller 34 and the conveyance roller 35 one by one, and then conveyed to a secondary transfer nip portion formed by the secondary transfer roller 26 and the endless belt 21 therebetween. The unfixed toner image on the endless belt 21 is transferred to the sheet S conveyed to the secondary transfer nip portion. The sheet S to which the unfixed toner image is transferred passes through an inlet IN between an inlet guide 54 arranged on the fixing unit 50 and a shutter unit 60 and is guided into the fixing unit 50. The sheet S is heated and pressed by a heating nip portion N formed by a roller pair PR in the fixing unit 50, whereby the unfixed toner image is fixed to the sheet S. The sheet S is then guided by the sheet discharge guide 51 and discharged to a discharge tray 53 by the discharge roller pair 52.

Figure 2:
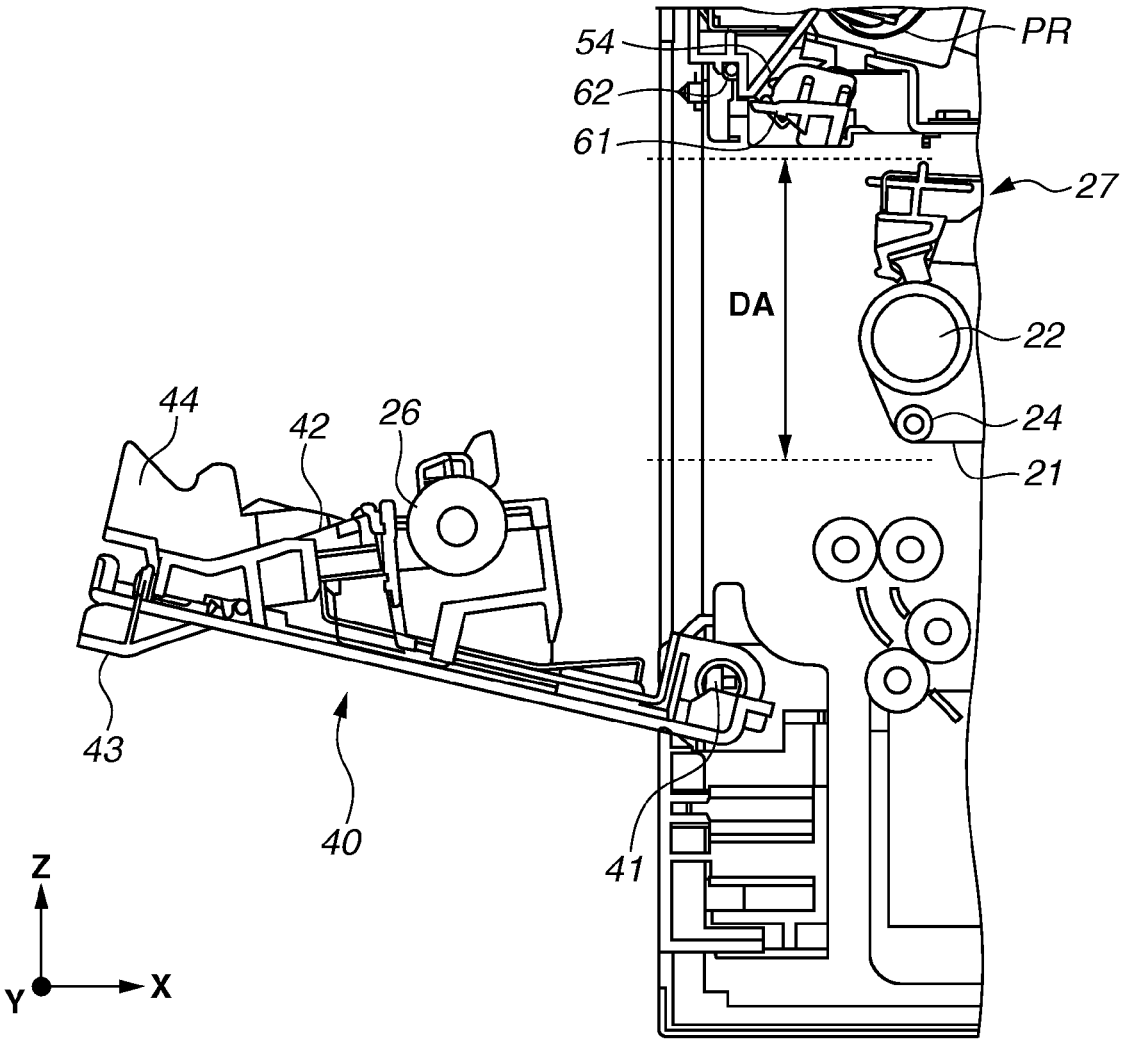
FIG. 2 is a sectional configuration diagram for describing an operation of a shutter and a door.
Figure 3:
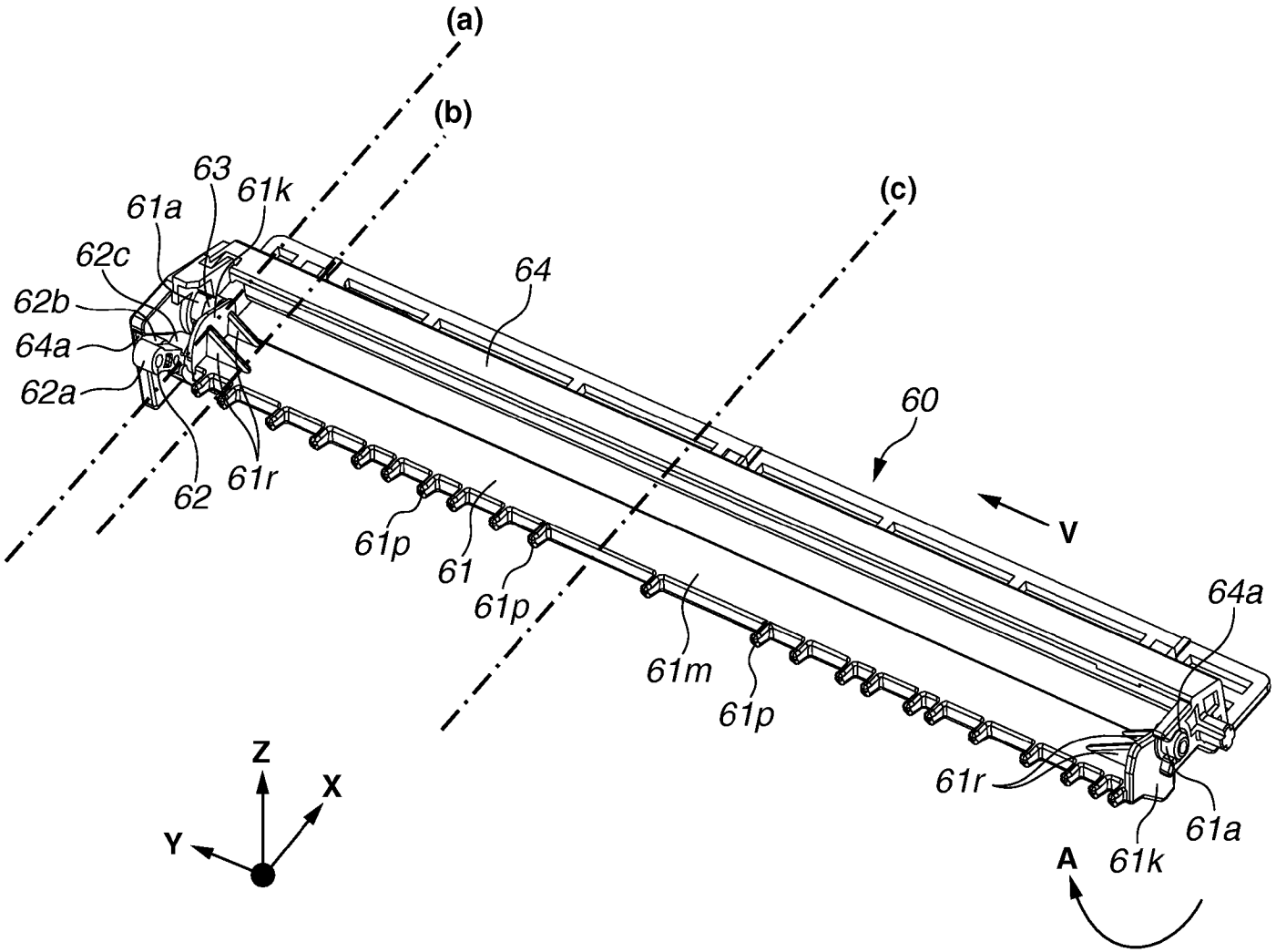
FIG. 3 is a perspective view for describing a shutter configuration.
Figure 4A:
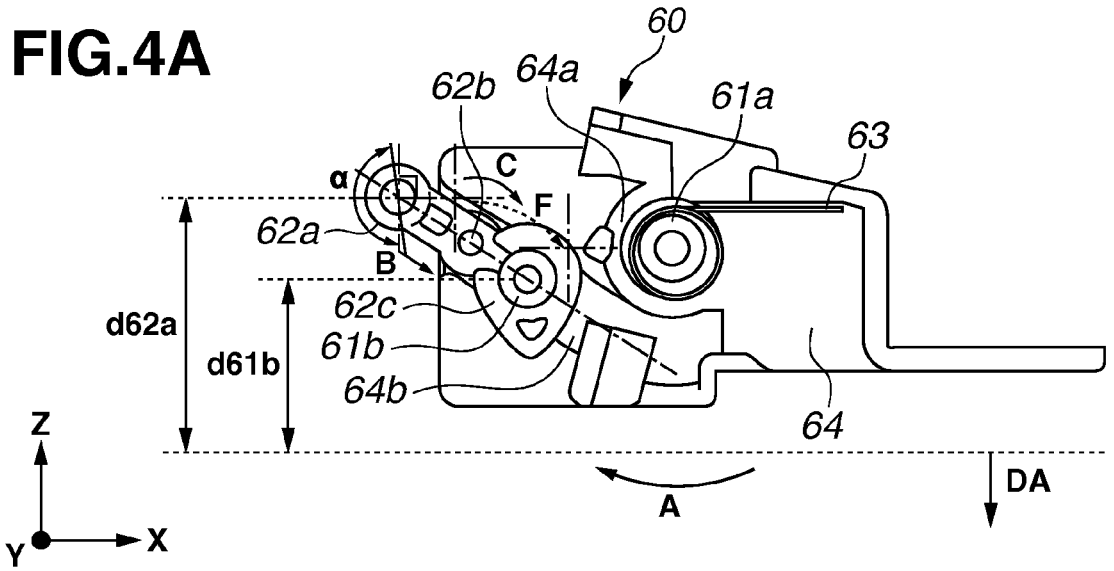
FIGS. 4A, 4B, and 4C are sectional views for describing a shutter operation.
Figure 4B:
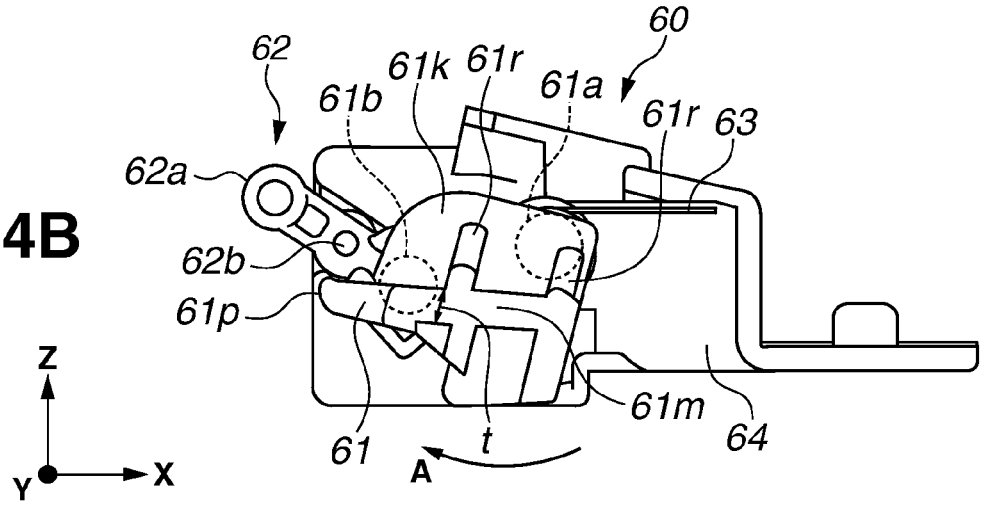
Figure 4C:
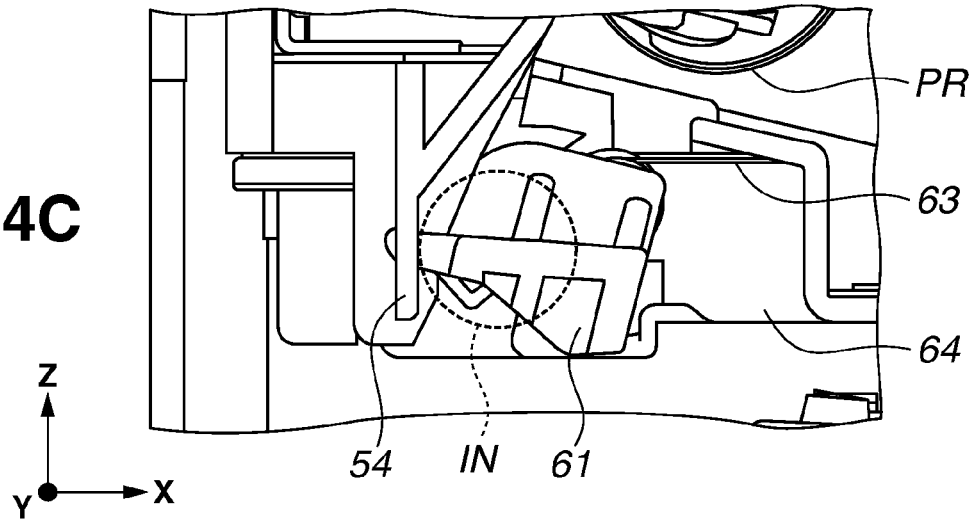

Next, the door (first opening/closing member) 40 and the shutter unit 60 will be described. FIG. 2 is a sectional view illustrating a state where the door 40 is open with respect to the main body 1 of the image forming apparatus. The door 40 is rotatably arranged on the main body 1 of the image forming apparatus with the rotation shaft 41 as a fulcrum. FIG. 3 illustrates a perspective view of the shutter unit 60 in the state where the door 40 is open. FIGS. 4A, 4B, and 4C illustrate sectional views of the shutter unit 60 in the state where the door 40 is open. FIGS. 4A, 4B, and 4C are sectional views of the sections along the lines (a), (b), and (c) in FIG. 3, respectively, as seen in the direction of an arrow V.

The shutter unit 60 includes a shutter (second opening/closing member) 61, a linkage member 62, a biasing member 63, and a shutter holder 64. The shutter unit 60 is configured to be arranged on the fixing unit 50 by the shutter holder 64 being attached to a casing of the fixing unit 50.

The shutter 61 includes a main body portion 61*m* which is elongated in a Y-axis direction (longitudinal direction of the shutter 61). The main body portion 61*m* has a substantially plate-like shape and can close the inlet IN of the fixing unit 50 over the Y-axis direction. Wall portions 61*k* are arranged on both ends of the main body portion 61*m* in the Y-axis direction. The main body portion 61*m* and the wall portions 61*k* are connected by ribs 61*r*, whereby the shutter 61 is reinforced. A plurality of protrusions 61*p* is arranged in the Y-axis direction on an end of the main body portion 61*m*. The protrusions 61*p* are portions for making contact with the inlet guide 54 to restrict movement of the shutter 61 which moves in a direction of closing the inlet IN.

The shutter 61 has a rotation shaft 61*a* on both ends thereof in the Y-axis direction. The shutter 61 is rotatably supported by bearings 64*a* arranged on the shutter holder 64. The shutter 61 further includes a pin (crank pin, first shaft)

61*b* on a portion radially off the rotation shaft 61*a*. As illustrated in FIG. 4B, the pin 61*b* is arranged in a position overlapping with the main body portion 61*m* in a thickness direction t of the main body portion 61*m*. The biasing member 63 is arranged coaxially with the rotation shaft 61*a*. The biasing member 63 biases the shutter 61 in a direction of an arrow A, that is, in a direction of closing the inlet IN of the fixing portion 50. The shutter 61 according to the present example is an integrally molded part including the main body portion 61*m*, the wall portions 61*k*, the ribs 61*r*, the protrusions 61*p*, the rotation shafts 61*a*, and the pin 61*b*.

The linkage member (connection rod) 62 includes a abutment portion 62*a* with which a pressing portion 44 of the door 40 to be described below makes contact, a shaft (second shaft) 62*b* which makes reciprocating motion, and a bearing 62*c* by which the pin 61*b* arranged on the shutter 61 is rotatably held. The abutment portion 62*a* is arranged on a side opposite from the bearing 62*c* with the shaft 62*b* at the center. The shaft 62*b* is arranged to be capable of being fitted into a recessed guide rail 64*b* formed in the shutter holder 64 and being reciprocated inside the guide rail 64*b*. If the shaft 62*b* of the linkage member 62 moves along the guide rail 64*b*, the shutter 61 rotates about the rotation shaft 61*a*. In such a manner, the shutter 61 and the linkage member 62 constitute a crank mechanism. The crank mechanism includes the pin 61*b* which is arranged on the portion of the shutter 61 radially off the rotation shaft 61*a* of the shutter 61, the shaft 62*b* which performs reciprocating movement in response to an opening and closing operation of the door 40, and the linkage member 62 which makes linkage between the pin 61*b* and the shaft 62*b*. In the present example, the crank mechanism is provided only on one end of the shutter unit 60 in the Y-axis direction. However, the crank mechanism may be provided on both ends.

Figure 5:
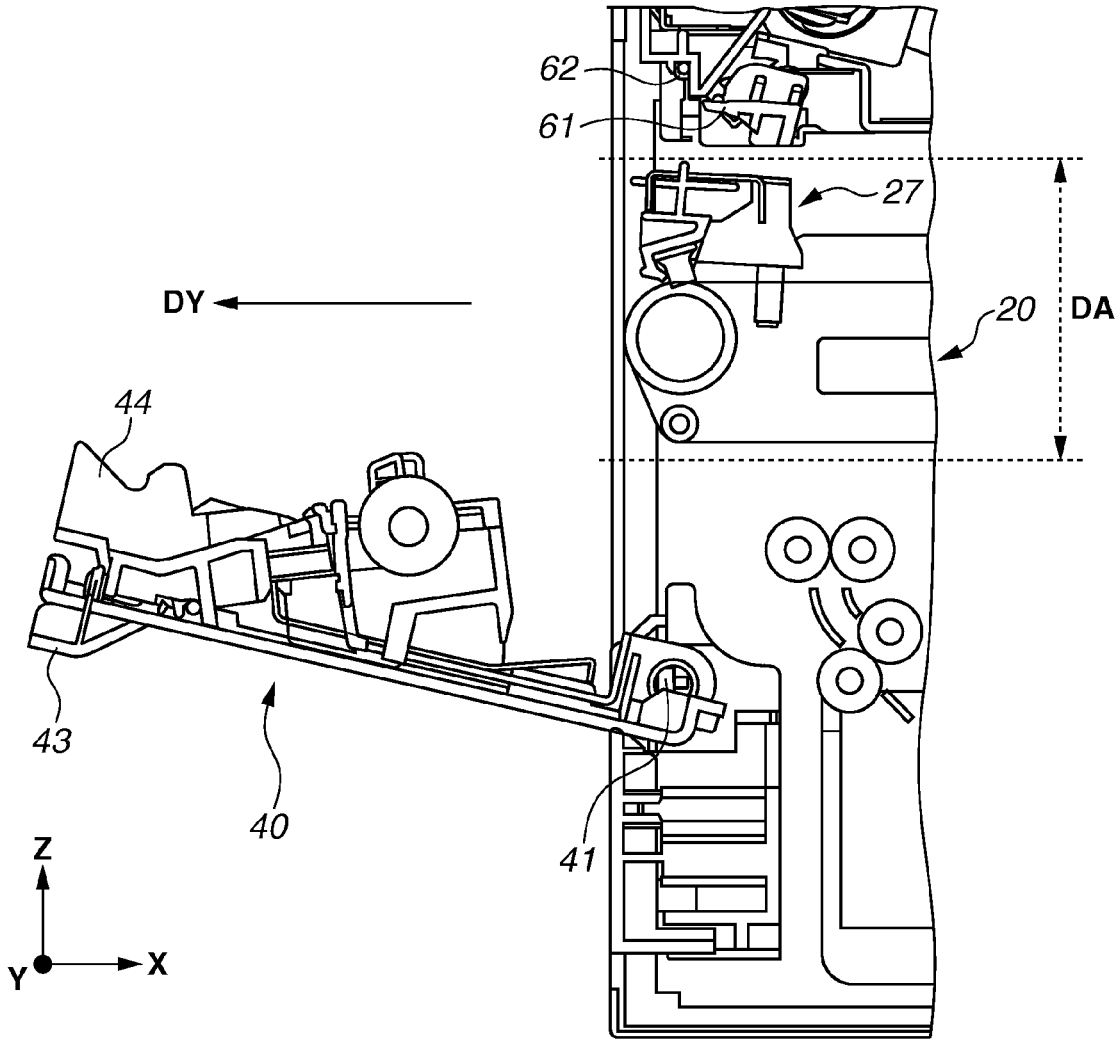
FIG. 5 is a sectional view for describing an operation for taking out a belt unit.

As illustrated in FIG. 4C, the position of the shutter 61 of when the inlet IN of the fixing unit 50 formed by the inlet guide 54 and the shutter 61 is closed will be referred to as a first position. As described above, the door 40 here is in the state of being open with respect to the main body 1. If the door 40 is open with respect to the main body 1, the inlet IN is closed by the shutter 61. The user putting his/her hand into the main body 1 is therefore unable to touch the inside of the fixing unit 50. In such a state, as illustrated in FIG. 5, the belt unit 20 which is a replaceable unit can be taken out in a DY direction. An area DA represents a moving space (moving area) of the belt unit 20 when attaching and detaching the belt unit 20.

Figure 6:
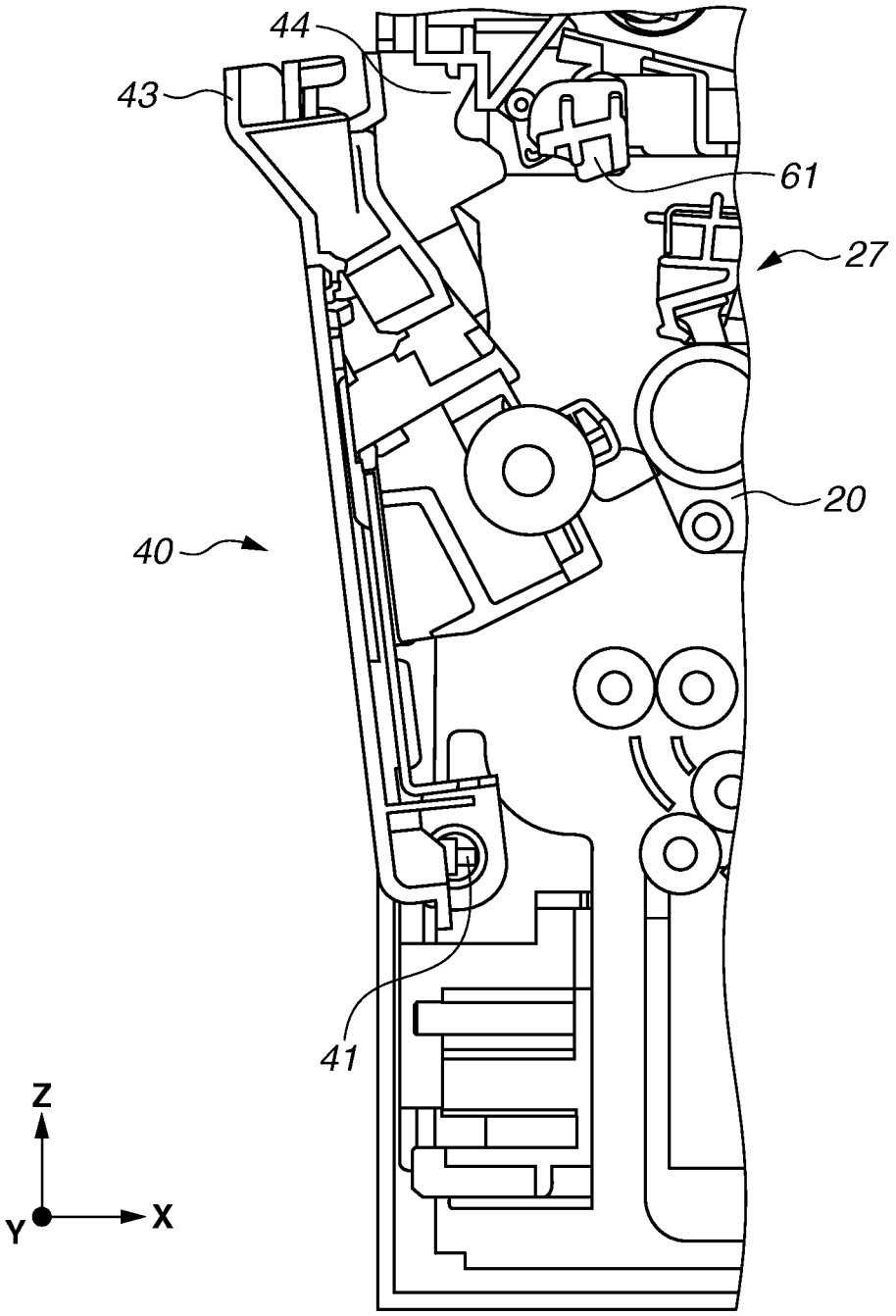
FIG. 6 is a sectional view for describing an operation of the shutter and the door.
Figure 7A:
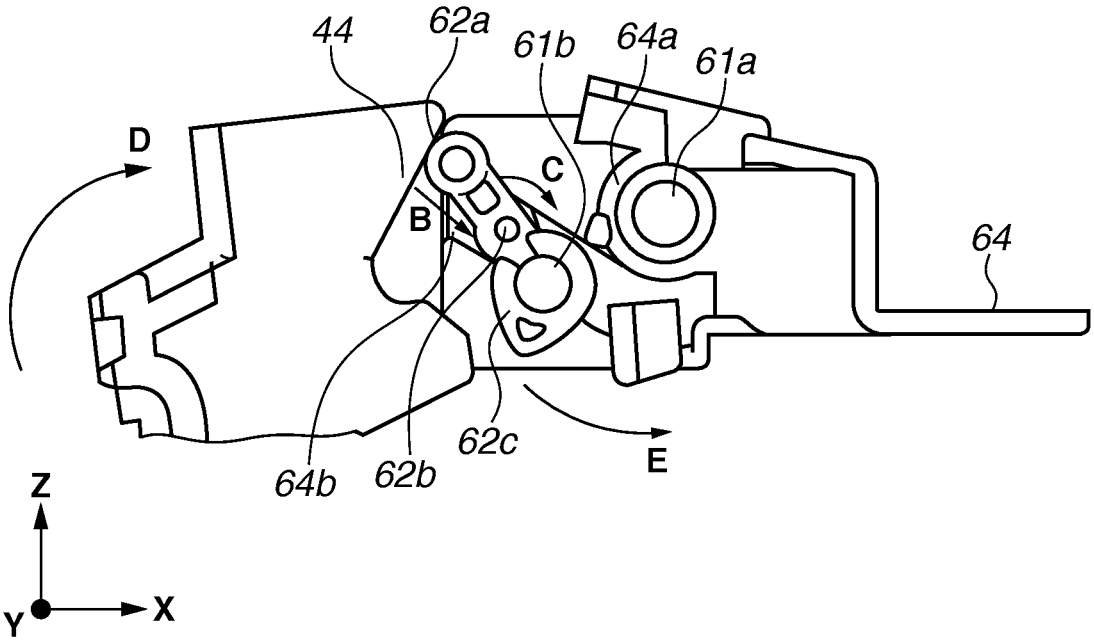
FIGS. 7A and 7B are sectional views for describing a shutter operation.
Figure 7B:
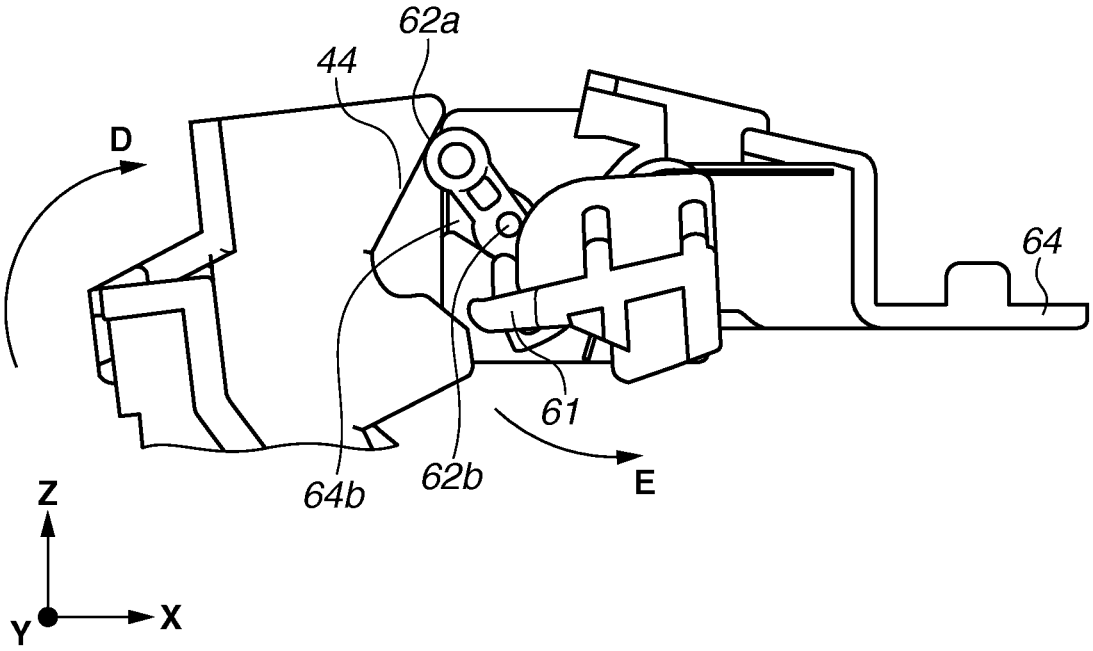

FIG. 6 is a sectional view of when the door 40 is being closed with respect to the main body 1. FIGS. 7A and 7B illustrate sectional views of the shutter unit 60 in such an intermediate stage. FIGS. 7A and 7B are sectional views in the positions of the lines (a) and (b) illustrated in FIG. 3, respectively. An operation of the shutter unit 60 will be described in detail below.

An operation for closing the door 40 with respect to the main body 1 (in a direction of an arrow D) brings the pressing portion 44 arranged on the door 40 into contact with the abutment portion 62*a* of the linkage member 62, and the pressing portion 44 starts to press the linkage member 62. The pressing portion 44 has an inclined surface, which triggers the crank mechanism to move and facilitates moving of the linkage member 62 even if the abutment portion 62*a* is positioned near a top dead center of the crank mechanism. Pressed by the pressing portion 44, the linkage member 62 moves in a direction of an arrow B along the guide rail 64*b* while rotating in a direction of an arrow C about the shaft 62*b*. If the linkage member 62 rotates in the direction of the arrow C, the shutter 61 is rotated about the rotation shaft 61*a* in a direction of an arrow E by force that the bearing 62*c* gives to the pin 61*c*. The operation of the shutter 61 during the period in which the linkage member 62 rotates in the direction of the arrow C will be referred to as a first operation. The first operation continues until the abutment portion 62*a* comes into contact with an annular ring of the bearing 64*a*.

Figure 8:
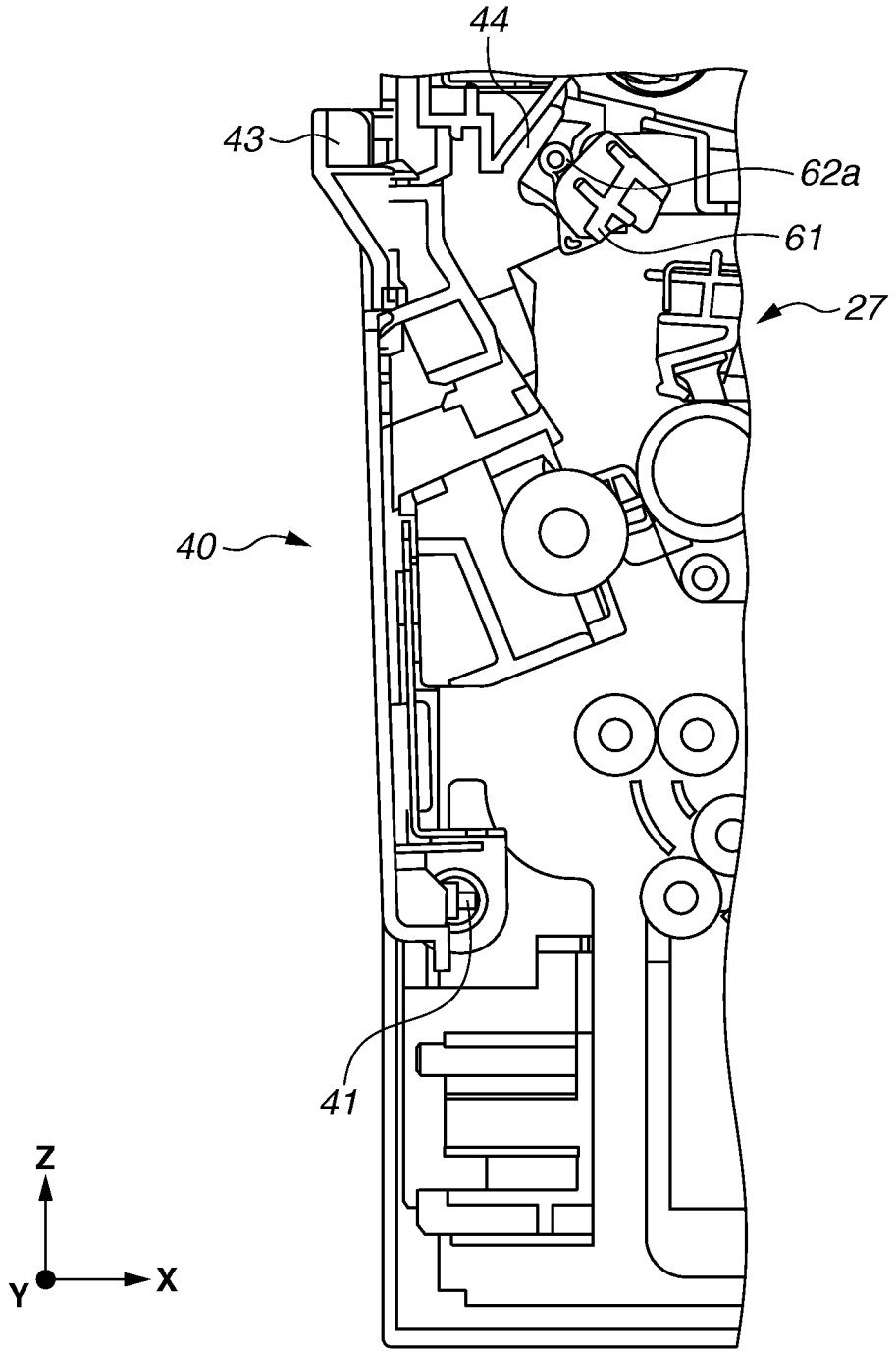
FIG. 8 is a sectional view for describing an operation of the shutter and the door.
Figure 9A:
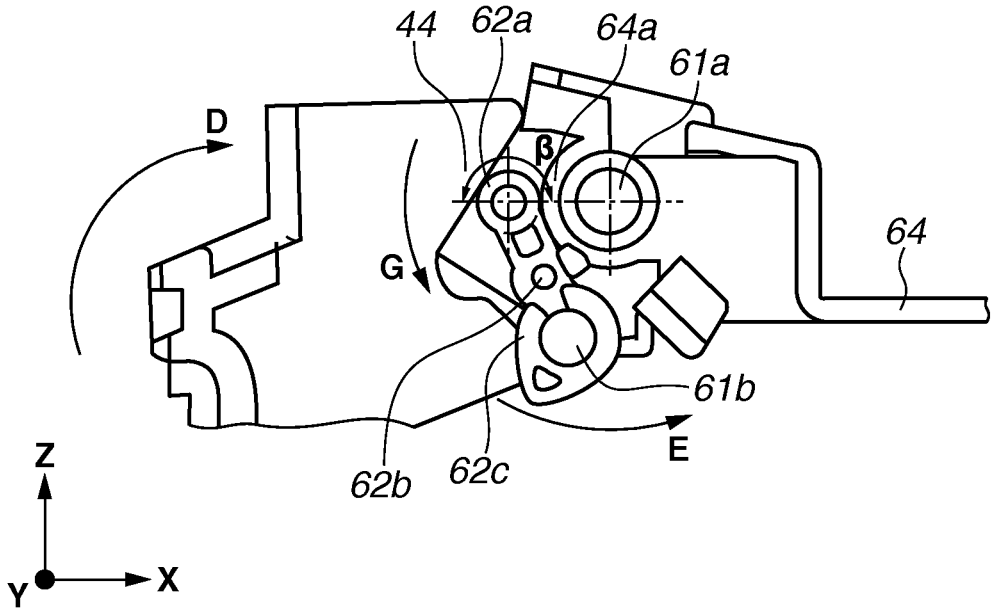
FIGS. 9A and 9B are sectional views for describing a shutter operation.
Figure 9B:
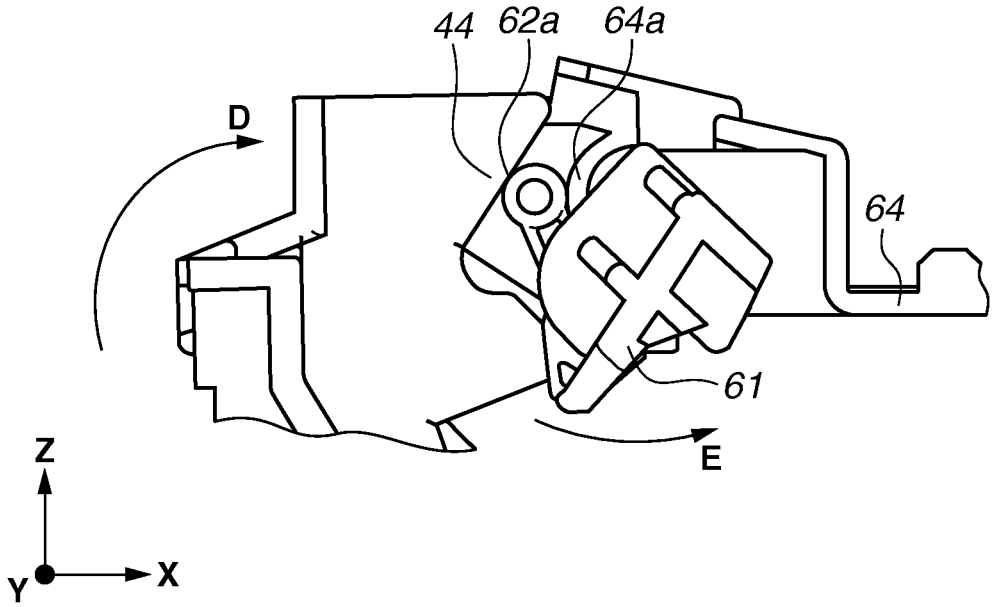

FIG. 8 illustrates a sectional view at the end of the first operation (in a state where the door 40 has rotated more in the direction of the arrow D than in the state illustrated in FIG. 6). FIGS. 9A and 9B illustrate sectional views of the shutter unit 60 in such a state. FIGS. 9A and 9B are sectional views in the positions of the lines (a) and (b) illustrated in FIG. 3, respectively. The amount of rotation of the shutter 61 can be increased by a second operation which will be described below.

If the operation for closing the door 40 with respect to the main body 1 (in the direction of the direction D) is continued, the abutment portion 62*a* in the state at the end of the first operation is further pressed by the pressing portion 44. As a result, the abutment portion 62*a* rotates about the bearing 64*a* in a direction of an arrow G while making contact with an outer periphery of the bearing 64*a*. At the same time, the shaft 62*b* moves further in the guide rail 64*b* in the direction of the arrow B. The rotation of the abutment portion 62*a* of the linkage member 62 in the direction of the arrow G causes the shutter 61 to further rotate about the rotation shaft 61*a* in the direction of the arrow E. The operation of the shutter 61 during the period during which the abutment portion 62*a* rotates in the direction of the arrow G will be referred to as a second operation. The second operation ends in a state where the door 40 is completely closed with respect to the main body 1.

Figure 10:
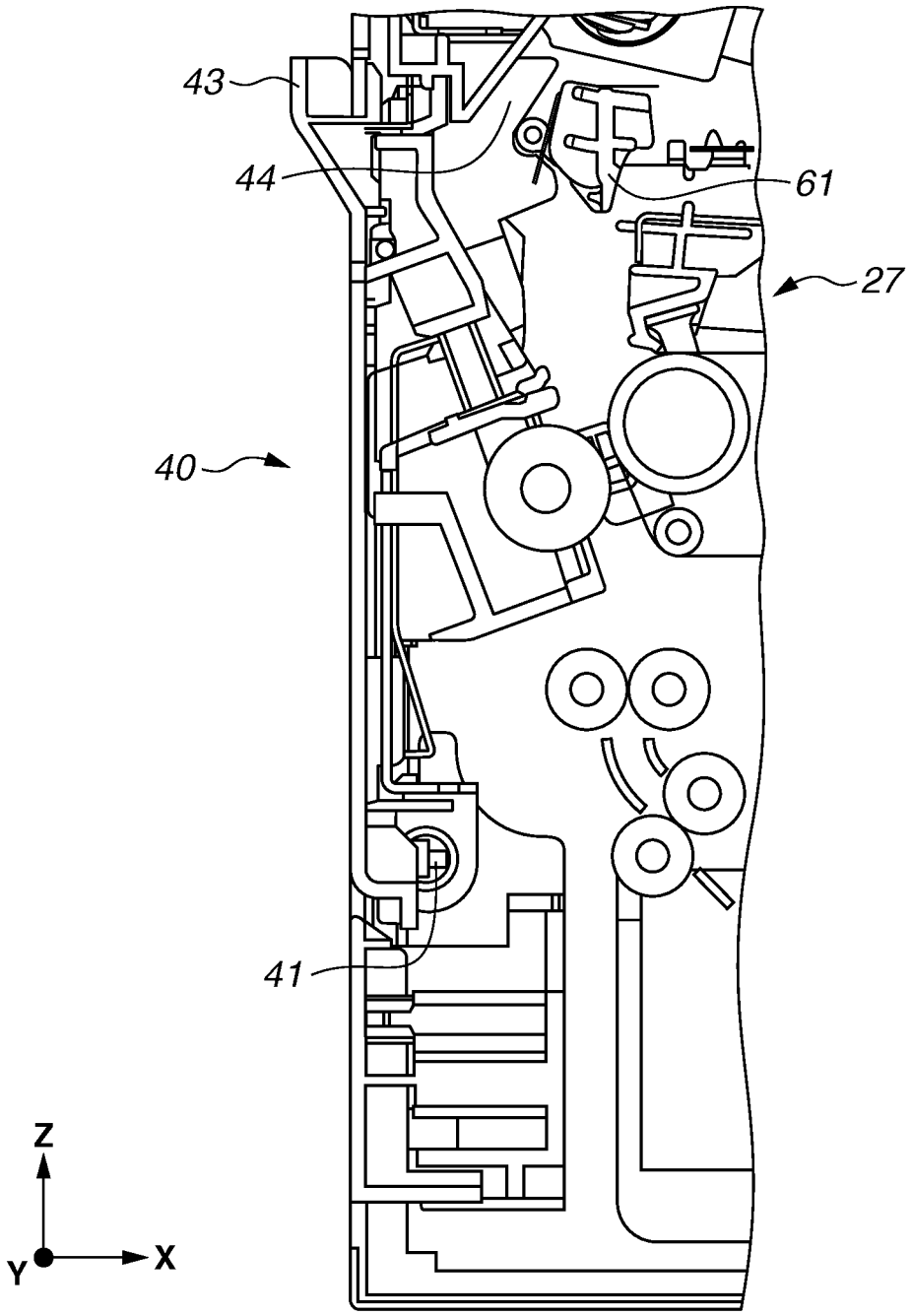
FIG. 10 is a sectional view for describing an operation of the shutter and the door.
Figure 11A:
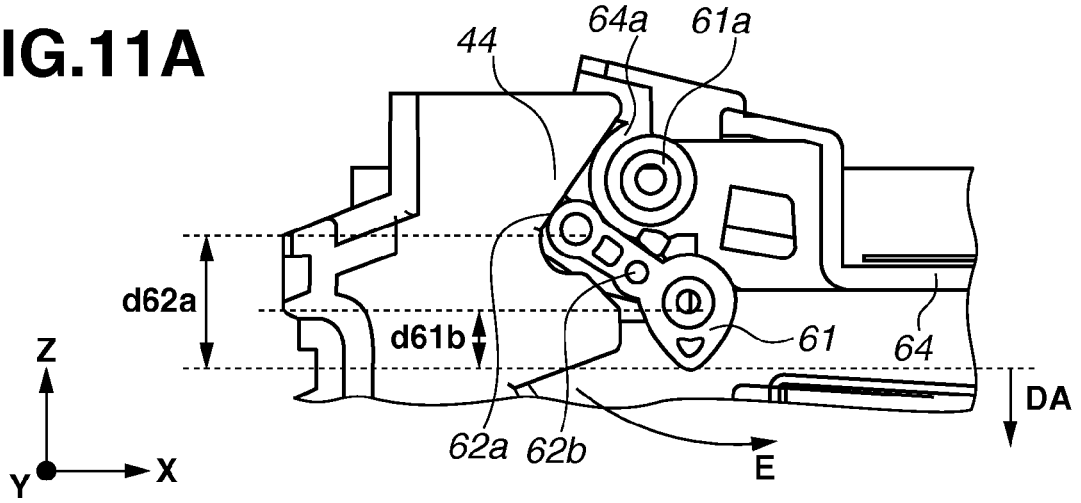
FIGS. 11A, 11B, and 11C are sectional views for explaining a shutter operation.
Figure 11B:
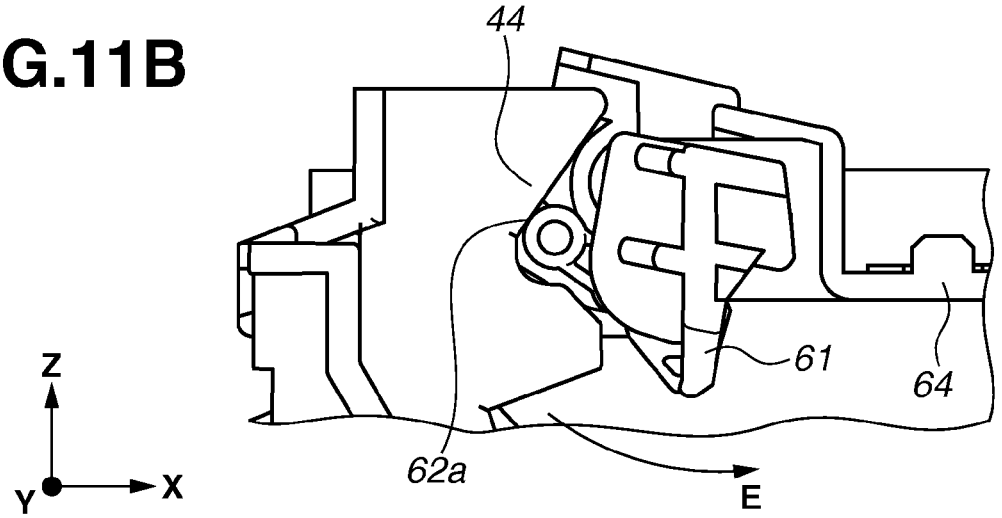
Figure 11C:
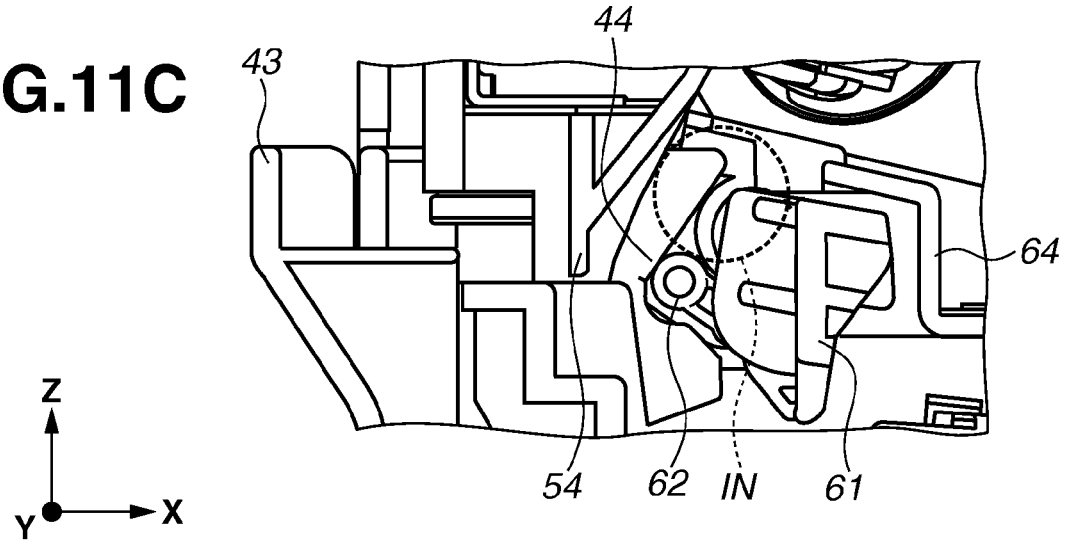
Figure 12:
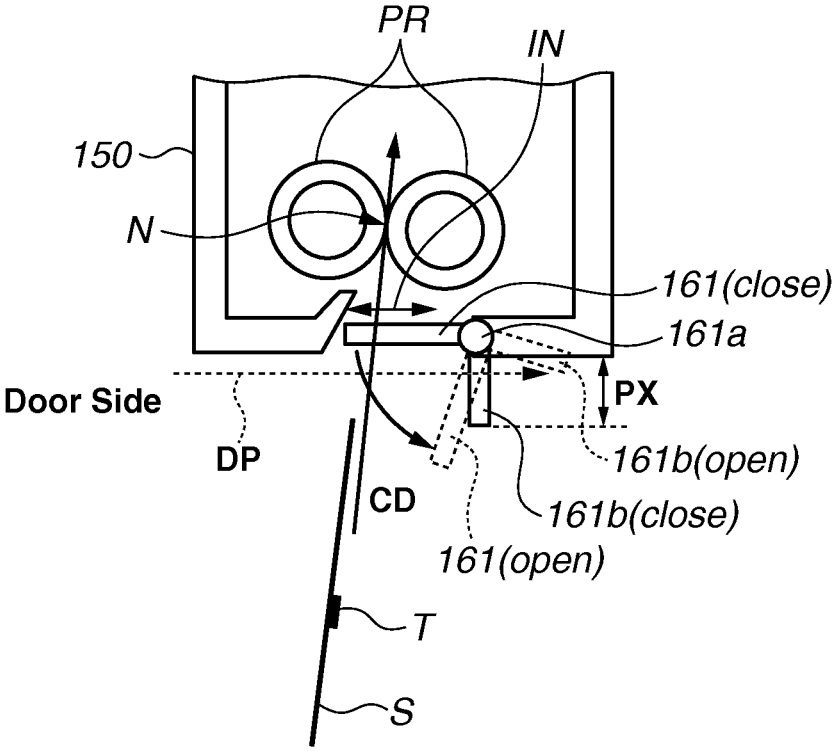
FIG. 12 is a sectional view for describing a shutter according to a comparative example.

FIG. 10 is a sectional view of the state where the door 40 is completely closed with respect to the main body 1. FIGS. 11A to 11C illustrate sectional views of the shutter unit 60 in such a state. FIGS. 11A, 11B, and 11C are sectional views in the positions of the lines (a), (b), and (c) illustrated in FIG. 3, respectively. As illustrated in FIG. 11A, the position of the shutter 61 with the inlet IN of the fixing unit 50 open will be referred to as a second position. Here, the door 40 is kept closed with respect to the main body 1 of the image forming apparatus by not-illustrated lock mechanisms arranged at both ends in the Y-axis direction of the main body 1 of the image forming apparatus.

If the user grips the door handle 43, the lock mechanisms are unlocked and the door 40 becomes openable with respect to the main body 1. If the door 40 is opened, the shutter 61 is returned to the first position at which the shutter 61 is caused to close the inlet IN of the fixing unit 50 by the biasing force of the biasing member 63.

As described above, the configuration for rotating the shutter 61 by using the crank mechanism can rotate the shutter 61 even though the portion which is to undergo the pressing force of the shutter 61, namely the pin 61*b*, is arranged in the position overlapping with the main body portion 61*m* of the shutter 61 in the thickness direction of the main body portion 61*m*. Suppose that as illustrated in FIG. 4B, the shutter 61 (the main body portion 61*m* thereof) moves to the first position where the inlet IN is closed. In such a case, since the pin 61*b* is positioned to overlap with the main body portion 61*m*, the position of the pin 61*b* also moves to a position sufficiently retracted from the moving space DA of the belt unit 20 which is a replaceable unit. This suppresses the amount of protrusion of the portion protruding from the fixing unit 50 toward the moving space DA of the belt unit 20. Thus, as illustrated in FIG. 5, the main body 1 of the image forming apparatus therefore does not need to be increased in size to enable the belt unit 20 to be taken out without its interfering with the shutter unit 60.

Next, the positional relationship of the parts of the shutter unit 60 in the foregoing first operation will be described with reference to FIG. 4A. FIG. 4A is a sectional view of the shutter unit 60 seen when the shutter 61 is in the first position. For example, suppose that the abutment portion 62*a*, the shaft 62*b*, the guide rail 64*b*, the bearing 62*c*, the pin 61*b*, the bearing 64*a*, and the rotation shaft 61*a* are in the positional relationship illustrated in FIG. 4A. If the abutment portion 62*a* is pressed within a range α, the linkage member 62 operates along a track illustrated by an arrow F which is obtained by combining the movement in the direction of the arrow B and the rotating motion in the direction of the arrow C.

Next, the positional relationship of the parts of the shutter unit 60 in the second operation will be described with reference to FIG. 9A. FIG. 9A is a sectional view of the shutter unit 60 of when the shutter 61 has completed the first operation. For example, suppose that the abutment portion 62*a*, the bearing 62*c*, the pin 61*b*, the bearing 64*a*, and the rotation shaft 61*a* are in the positional relationship illustrated in FIG. 9A. If the abutment portion 62*a* is pressed within a range 13, the linkage member 62 rotates about the bearing 64*a* in the direction of the arrow G.

In other words, according to the present exemplary embodiment, the operation for closing the door 40 causes the linkage member 62 to move in the direction of the arrow B while making the rotating motion in the direction of the arrow C in the first operation, and to make the rotating motion in the direction of the arrow G in the second operation. As a result, the shutter 61 rotates from the first position to the second position. In such a manner, the shutter 61 makes the second operation in addition to the first operation, which results in ensuring a greater amount of rotation in a small space.

Furthermore, as illustrated in FIG. 4A, in the state where the door 40 is open, a first distance d62*a* from the area DA which is the moving space of the belt unit 20 to the abutment portion 62*a* with which the pressing portion of the door 40 comes into contact is greater than a second distance d61*b* from the area DA to the crank pin (first shaft) 61*b*. Such a relationship enables to ensure a smooth operation of the crank mechanism. In the present exemplary embodiment, the relationship d62*a*>d61*b* is maintained from when the door 40 is in the opened state (the state of FIG. 4A) to when the door 40 is in the closed state (the state of FIG. 11A).

The first opening/closing member has been described by using the door 40 that is operated for taking out the belt unit 20. However, other doors such as a door operated for attaching and detaching the process cartridges PY, PM, PC, and PK may be used as the first opening/closing member. The foregoing crank mechanism may be applied to the members for moving the shutter of the fixing unit 50 in conjunction with the operation of the door.

The relationship between the crank pin 61*b* and the bearing 62*c* which rotatably supports the crank pin 61*b* may be reversed. Specifically, the member 61*b* may be a bearing, and the member 62*c* a crank pin.

According to an exemplary embodiment of the present invention, an image forming apparatus that can suppress the amount of protrusion of a portion protruding from a fixing unit can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242585, filed Nov. 28, 2014, which is hereby incorporated by reference herein in its entirety.

What is claimed is:

1. An image forming apparatus for forming a toner image on a recording material, the image forming apparatus comprising:

a main body of the image forming apparatus;

a first opening/closing member configured to form part of an outer casing of the main body and arranged to be openable and closable with respect to the main body;

a second opening/closing member arranged inside the main body;

a unit detachably attachable to the main body, the unit being attachable to and detachable from the main body in a state where the first opening/closing member is open; and a crank mechanism configured to convert reciprocating motion caused by an opening and closing operation of the first opening/closing member into rotating motion of the second opening/closing member, the crank mechanism including a crank pin and a bearing configured to hold the crank pin and either the crank pin or the bearing being arranged on part of the second opening/closing member, wherein the first opening/closing member is provided at a side opposite from a surface of the recording material on which an unfixed toner image is formed, wherein the second opening/closing member is provided at a side opposed to the surface of the recording material on which an unfixed toner image is formed, and wherein the crank pin or the bearing is arranged at a position overlapping with a main body portion of the second opening/closing member in a thickness direction of the main body portion.

2. The image forming apparatus according to claim 1, wherein the crank mechanism further includes a shaft configured to make the reciprocating motion in conjunction with the opening and closing operation of the first opening/closing member, and a linkage member configured to link the crank pin or the bearing with the shaft.

3. The image forming apparatus according to claim 1, wherein the main body includes inside a fixing unit configured to fix the toner image formed on the recording material onto the recording material, and wherein the second opening/closing member is a member configured to open and close an inlet through which the recording material enters the fixing unit.

4. The image forming apparatus according to claim 1, wherein the unit is a belt unit configured to transfer the toner image to the recording material.

5. An image forming apparatus for forming a toner image on a recording material, the image forming apparatus comprising:

a main body of the image forming apparatus;

a first opening/closing member configured to form part of an outer casing of the main body and arranged to be openable and closable with respect to the main body;

a second opening/closing member arranged inside the main body;

a belt unit arranged inside the main body and configured to transfer the toner image to the recording material, the belt unit being attachable to and detachable from the main body in a state where the first opening/closing member is open; and a crank mechanism configured to convert reciprocating motion caused by an opening and closing operation of the first opening/closing member into rotating motion of the second opening/closing member, the crank mechanism including a crank pin and a bearing configured to hold the crank pin and either the crank pin or the bearing being arranged on part of the second opening/closing member, wherein the main body includes inside a fixing unit configured to fix the toner image transferred to the recording material by the belt unit onto the recording material, wherein the second opening/closing member is a member configured to open and close an inlet through which the recording material enters the fixing unit, wherein the first opening/closing member is provided at a side opposite from a surface of the recording material on which an unfixed toner image is formed, wherein the second opening/closing member is provided at a side opposed to the surface of the recording material on which an unfixed toner image is formed, and wherein the crank pin or the bearing is arranged at a position overlapping with a main body portion of the second opening/closing member in a thickness direction of the main body portion.

6. The image forming apparatus according to claim 1, wherein the first opening/closing member is a side cover of the main body perpendicular to a bottom of the apparatus.

7. The image forming apparatus according to claim 5, wherein the first opening/closing member is a side cover of the main body perpendicular to a bottom of the apparatus.

8. An image forming apparatus for forming a toner image on a recording material, the image forming apparatus comprising:

a main body of the image forming apparatus;

a first opening/closing member configured to form part of an outer casing of the main body and arranged to be openable and closable with respect to the main body;

a fixing unit configured to fix an unfixed toner image formed on the recording material, the fixing unit includes a second opening/closing member configured to open and close an inlet through which the recording material enters the fixing unit; and a crank mechanism configured to convert reciprocating motion caused by an opening and closing operation of the first opening/closing member into rotating motion of the second opening/closing member, the crank mechanism including a crank pin and a bearing configured to hold the crank pin and either the crank pin or the bearing being arranged on part of the second opening/closing member, wherein the first opening/closing member is provided at a side opposite from a surface of the recording material on which an unfixed toner image is formed, wherein the second opening/closing member is provided at a side opposed to a surface of the recording material on which an unfixed toner image is formed, and wherein the crank pin or the bearing is arranged at a position overlapping with a main body portion of the second opening/closing member in a thickness direction of the main body portion.

9. The image forming apparatus according to claim 8, further comprising a unit arranged inside the main body, the unit being attachable to and detachable from the main body in a state where the first opening/closing member is open.

10. The image forming apparatus according to claim 8, wherein the first opening/closing member is a side cover of the main body perpendicular to a bottom of the apparatus.

* * * * *